US005762119A

United States Patent [19]

Platz et al.

[11] Patent Number: 5,762,119

[45] Date of Patent: Jun. 9, 1998

[54] CRYOGENIC GAS TRANSPORTATION AND DELIVERY SYSTEM

[75] Inventors: Richard J. Platz; O. Kendall Kelley, both of Amarillo, Tex.

[73] Assignee: Golden Spread Energy, Inc., Amarillo, Tex.

[21] Appl. No.: 757,267

[22] Filed: Nov. 29, 1996

[51] Int. Cl.[6] ..... F17C 7/04

[52] U.S. Cl. ..... 141/231; 141/2; 141/4; 141/18; 141/82; 62/50.2; 62/50.7

[58] Field of Search ..... 141/2–4, 11, 18, 141/21, 82, 83, 231; 62/50.2, 50.7, 53.2

[56] References Cited

U.S. PATENT DOCUMENTS

| | | | |
|---|---|---|---|
| 2,400,037 | 5/1946 | Arndt et al. | 62/50.2 |
| 2,463,098 | 3/1949 | Goddard | 62/50.2 |
| 2,469,434 | 5/1949 | Hansen et al. | 62/50.2 |
| 2,784,747 | 3/1957 | Weempe | 141/21 |
| 2,964,918 | 12/1960 | Hansen et al. | 141/4 |
| 4,870,830 | 10/1989 | Hohenwarter et al. | 62/50.7 |
| 5,409,046 | 4/1995 | Swenson et al. | 141/11 |
| 5,590,535 | 1/1997 | Rhoades | 62/50.2 |

OTHER PUBLICATIONS

Henderson International Technologies, Inc., Richardson, Texas, Manual (1984).

*Primary Examiner*—J. Casimer Jacyna
*Attorney, Agent, or Firm*—McAfee & Taft

[57] ABSTRACT

A cryogenic gas transportation and delivery system for transporting the gas in a liquefied state and delivering it to a storage vessel in a vaporized or gaseous state. The system includes a mobile chassis, a vacuum-jacketed delivery vessel for storing the gas in the liquefied state, a vaporizer for vaporizing the liquefied gas into a vaporized state, and a compressor or pump to transfer the gas through the system so that it is delivered to the storage vessel as a compressed gas. When a compressor is used, the compressor is disposed between the vaporizer and the storage vessel. When a liquid pump is used, the pump is installed between the delivery vessel and the vaporizer.

9 Claims, 3 Drawing Sheets

CRYOGENIC GAS TRANSPORTATION AND DELIVERY SYSTEM

BACKGROUND OF THE INVENTION

1. Field of the Invention

This invention relates to systems for transporting and delivering cryogenic gases, and more particularly, to a system which allows transportation of the gas in a liquefied state and delivery to a storage vessel in a vaporized or gaseous state.

2. Description of the Prior Art

Most cryogenic gases, such as helium, are used in a gaseous state and therefore sold in the gaseous state. Transporting such cryogenic gases in a gaseous state has been known for many years. However, the total volume of cryogenic gas which can be transported in a gaseous state is considerably less than can be done in a liquid state. With helium, for example, the liquid may contain over five times as many helium molecules as an equal volume of compressed gaseous helium.

Therefore, there is a need to transport the cryogenic gas in its liquefied state to maximize the quantity of gas but still deliver it to the ultimate user in a gaseous state. The present invention solves this problem by providing a mobile system utilizing a cryogenic delivery vessel for holding the gas in its liquefied state and having a vaporizer to warm the liquefied gas and vaporize it so that it can be delivered to a storage vessel in a vaporized or gaseous state. A gas compressor or liquid pump moves the cryogenic gas through the system.

SUMMARY OF THE INVENTION

The present invention is a cryogenic gas transportation and delivery system designed to transport the gas to a desired location in a liquefied state and transferring the gas in a vaporized or gaseous state into a compressed gas storage vessel. Generally, the system is portable and comprises a mobile chassis, a liquefied gas delivery vessel, a vaporizer, and a gas transferring means. The liquefied gas delivery vessel is adapted for storing the gas in a liquefied state. The vaporizer has a vaporizer inlet in communication with a liquid section of the delivery vessel and has a vaporizer outlet. The vaporizer is adapted for vaporizing liquefied gas received from the delivery vessel and discharging the gas through the vaporizer outlet in a vaporized state. The gas transferring means is for transferring gas from the delivery vessel in the liquefied state, through the vaporizer and to the storage vessel in the vaporized state.

The delivery vessel is vacuum jacketed, and the vaporizer inlet is connected to the delivery vessel with vacuum-jacketed piping. The system may further comprise a vaporizer bypass in communication with a vapor section of the delivery vessel. The vaporizer bypass is connected to the vapor section of the delivery vessel with vacuum-jacketed piping. The vacuum-jacketed piping as described herein is only necessary when the cryogenic gas is hydrogen or helium. With other cryogenic gases, insulated piping is usually all that is necessary.

Preferably, an accumulator is disposed between the vaporizer outlet and the storage vessel to eliminate or at least minimize pressure fluctuations in the system.

In a first embodiment, the gas transferring means is characterized by a gas compressor having a compressor inlet in communication with the vaporizer outlet and a compressor outlet in communication with the storage vessel. An oil filter may be placed in communication with the compressor outlet as necessary. In this embodiment, the accumulator is also in communication with the compressor inlet.

In another embodiment, the gas transferring means is characterized by a liquid pump having a pump inlet in communication with the delivery vessel and a pump outlet in communication with the vaporizer inlet. An inlet strainer may be disposed between the delivery vessel and the pump inlet, and vibration eliminators may be disposed on opposite sides of the pump.

The present invention also includes a method of transporting and delivering a cryogenic gas which comprises the steps of transferring liquefied cryogenic gas into a delivery vessel on a mobile chassis, transporting the chassis with the cryogenic gas in the delivery vessel to a desired location adjacent to a storage vessel, flowing liquefied gas out of the delivery vessel, vaporizing the liquefied gas into a vaporized gas, and transferring at least some of the vaporized gas to the storage vessel. The step of vaporizing may be carried out by passing the liquefied gas through a vaporizer disposed on the mobile chassis.

The step of transferring gas may be carried out by pumping the vaporized gas through a gas compressor and discharging the vaporized gas into the storage vessel. The step of transferring gas may alternatively be carried out by pumping liquefied gas from the storage vessel with a liquid pump.

The method may further comprise the step of bypassing excess vaporized gas back to a vapor section of the delivery vessel.

Numerous objects and advantages of the invention will become apparent as the following detailed description of the preferred embodiments is read in conjunction with the drawings which illustrate such embodiments.

DESCRIPTION OF THE PREFERRED EMBODIMENTS

Figure 1:
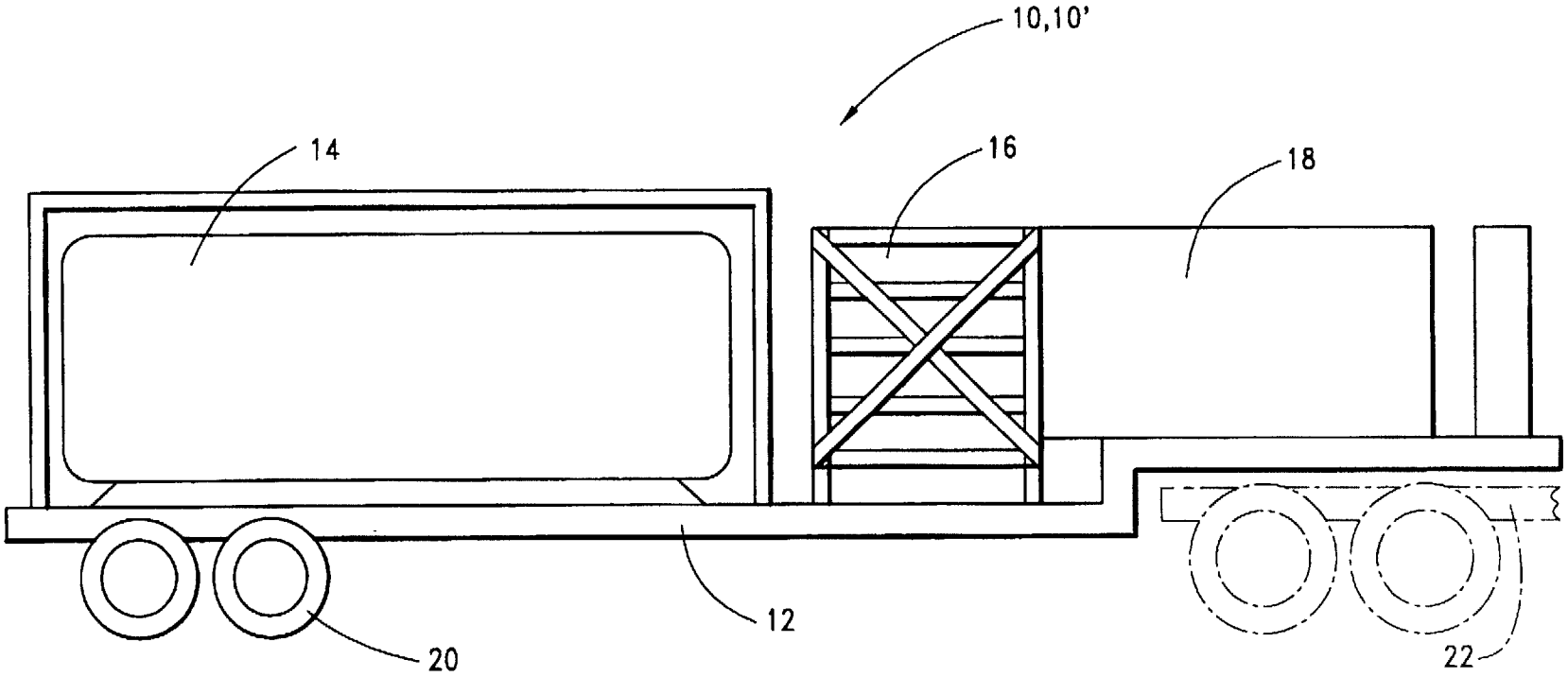
FIG. 1 shows a side elevation view of the cryogenic gas transportation and delivery system of the present invention and illustrating the major components thereof.

Referring now to the drawings, and more particularly to FIG. 1, the cryogenic gas transportation and delivery system of the present invention is shown and generally designated by the numeral 10. The major components of system 10 include a mobile chassis 12, a cryogenic delivery vessel 14, a vaporizer 16 and a gas transferring means 18. As will be further described herein, cryogenic gas transferring means 18 may include a gas or vapor compressor or a liquid pump.

Interconnecting piping and various fittings, including valves, are omitted from FIG. 1 for clarity.

In the illustrated embodiment, mobile chassis 12 is in the form of a trailer having a plurality of wheels 20 and is adapted for connection to and towing by a vehicle 22, such as a truck tractor. In this embodiment, the other components are mounted on chassis 12. In an alternate embodiment (not shown), the other components could be mounted to a skid which could then be transported on a flat bed trailer.

Figure 2:
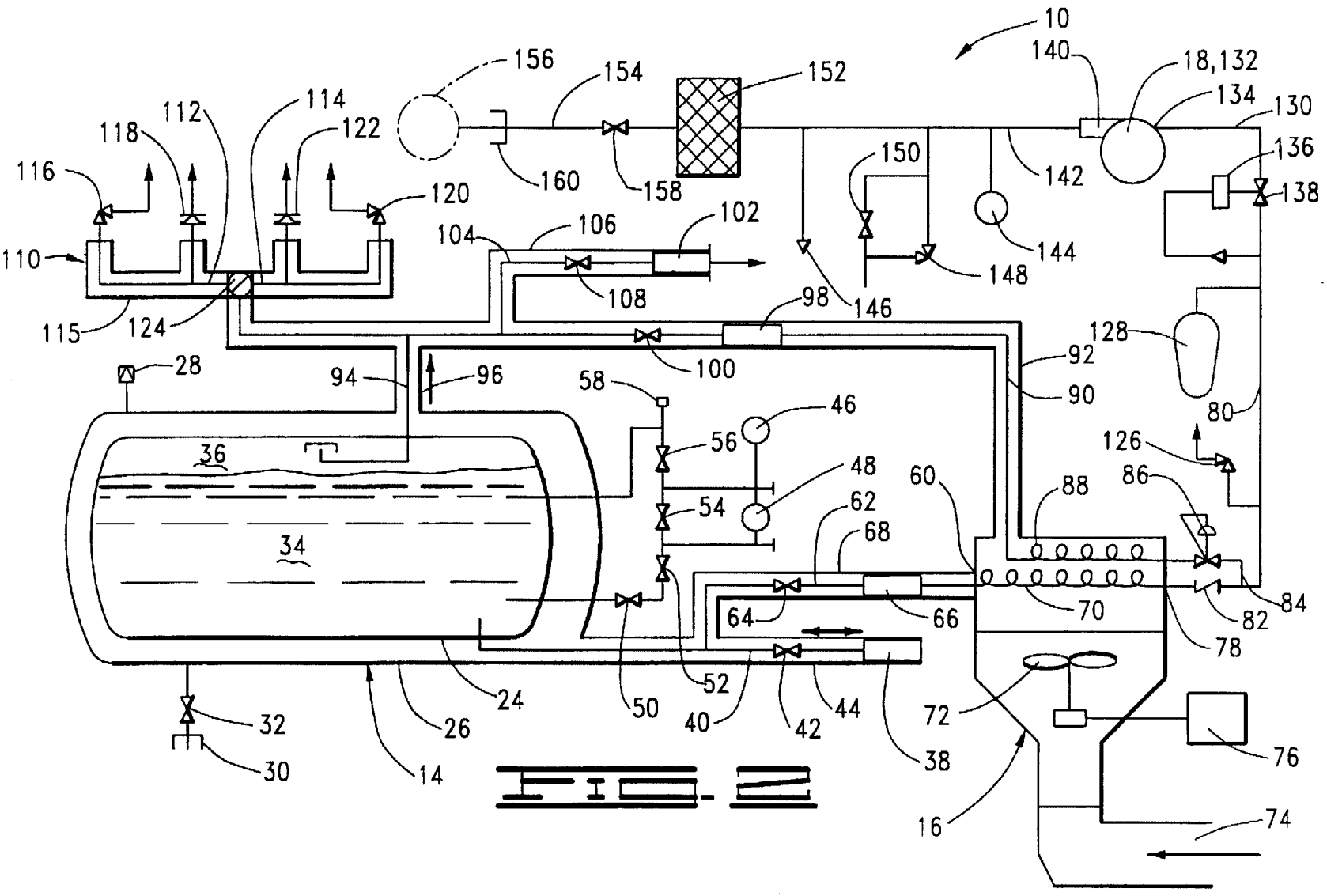
FIG. 2 is a piping schematic of a first embodiment of the invention.

Referring now to FIG. 2, a first embodiment system 10 is illustrated by a piping schematic. Preferably, delivery vessel 14 is a jacketed, cryogenic tank, such as the Cryenco TheVAC. This type of vessel 14 has an inner tank 24 with an outer jacket 26 which provides an insulating vacuum therebetween.

In the event of leakage of cryogenic gas into the vacuum between inner tank 24 and outer jacket 26, a jacket vacuum relief valve 28 is provided to insure that there is no pressure buildup between the inner tank and the jacket.

The vacuum inside jacket 26 is monitored by a vacuum gauge thermocouple 30. An isolation valve 32 is used to isolate thermocouple 30 so that it can be changed.

When delivery vessel 14 is filled with any cryogenic gas, such as helium, there is always a liquid section 34 and a vapor section 36. That is, there is always some gaseous or vaporized gas above the liquefied gas. Those skilled in the art will see that the vapor section and liquid section are in substantial pressure and temperature equilibrium when nothing is flowing through the system.

Delivery vessel 14 is filled with the liquefied cryogenic gas through a fill and drain connection 38, of a kind known in the art at the end of a fill line 40. A fill and drain valve 42 may be used to open and close fill line 40 as desired.

It will be seen that fill line 40 is connected to liquid section 34 of delivery vessel 14. The illustrated embodiment shows fill line 40 to be vacuum jacketed with a fill line jacket 44 therearound which is in communication with outer jacket 26 of delivery vessel 14. Vacuum-jacketing of the piping, such as fill line 40, is necessary for systems in which the cryogenic gas is hydrogen or helium. For other cryogenic gases, fill line 40 does not require vacuum jacketing and may be insulated.

Additional instrumentation for delivery vessel 14 may include a pressure gauge 46 and a liquid level gauge 48. These gauges may be isolated from delivery vessel 34 by one or more of a plurality of isolation valves. These isolation valves include a high pressure gauge line isolation valve 50, an instrument panel isolation valve 52, a liquid level gauge equalizer valve 54, and a low pressure isolation valve 56. A sampling connection 58 may be provided to allow a product sample to be taken from delivery vessel 14.

Vaporizer 16 has a vaporizer inlet 60 which is connected to a vaporizer inlet line 62. Vaporizer inlet line 62 may be opened and closed using a vaporizer liquid isolation valve 64, and line 62 may be disconnected with a liquid phase delivery connection 66. Vaporizer inlet line 62 is connected to fill line 40 and thus is in communication with liquid section 34 of delivery vessel 14. Vaporizer inlet line 62 may be vacuum jacketed with an inlet line jacket 68 which is connected to fill line jacket 44. Thus, there is a vacuum between inlet line jacket 68 and vaporizer inlet line 62.

Vaporizer 14 itself is of a kind generally known in the art and includes a primary heat exchanger 70 into which the liquefied cryogenic gas enters through inlet line 62. The liquefied gas is heated and eventually vaporized by heat transfer, accelerated in part by a fan 72 which blows ambient air across heat exchanger 70. Air enters vaporizer 10 through an air inlet 74. Fan 72 is driven by a prime mover, such as an electric motor 76.

Vaporizer 16 has a vaporizer outlet 78 which is connected to a vaporizer outlet line 80 having a check valve 82 therein. A gas economizer line 84 is connected to vaporizer outlet line 80 at a point downstream from check valve 82. A gas economizer valve 86 is disposed in gas economizer line 84 and is in communication with a secondary heat exchanger 88 in vaporizer 16. A bypass line 90 is connected to secondary heat exchanger 88. Bypass line 90 may be vacuum jacketed with an outer bypass line jacket 92 therearound. Bypass line 90 is in communication with a vapor section line 94 which is connected to vapor section 36 of delivery vessel 14. Vapor section line 94 may also be vacuum jacketed and therefore having a vapor section line jacket 96 therearound. Bypass line 90 may be disconnected utilizing a gas phase delivery connection 98 and may be closed with a vaporizer gas isolation valve 100.

A gas vent connection 102 is in communication with vapor section line 94 through a gas vent line 104. Gas vent line 104 may also be vacuum jacketed with a gas vent line jacket 106 therearound. Gas vent line 104 may be opened and closed by gas vent valve 108.

A relief manifold 110 is connected to vapor section line 94 and has a first branch 112 and a second branch 114. Relief valve manifold 110 may be vacuum jacketed so that it has a relief valve manifold jacket 115 therearound. First branch 112 includes a first relief valve 116 and a first rupture or burst disc 118. Similarly, second branch 114 has a second relief valve 120 and a second rupture or burst disc 122. Relief valves 116 and 120 are substantially identical, and burst discs 118 and 122 are substantially identical. An operator may selectively switch between first branch 112 and second branch 114 of relief manifold 110 by use of a relief selector valve 124. As illustrated in FIG. 2, relief selector valve 124 is in a position such that second branch 114 is connected to vapor section line 94, and first branch 110 is closed off.

In the event that inner tank 24 of delivery vessel 14 becomes overpressurized, it will be seen by those skilled in the art that relief valves 116 and 120 and burst discs 118 and 122 provide pressure relief. By having two sets of relief valves and rupture discs, one set may be used to provide protection for delivery vessel 14 while the others are being installed, repaired or replaced.

Vaporizer outlet line 80 has a vaporizer relief valve 126 in communication therewith to prevent overpressurization of vaporizer 16.

An accumulator 128 is in communication with vaporizer outlet line 80 and is adapted to minimize pressure fluctuations that can occur in system 10. Vaporizer outlet line 80 is connected to a compressor inlet line 130. In the embodiment of FIG. 2, gas transferring means 18 is characterized by a gas compressor 132 having a compressor inlet 134 to which compressor inlet line 130 is connected. The temperature of vaporized gas entering compressor 132 may be measured by a thermocouple 136. Thermocouple 136 may be isolated from compressor 132 by a low temperature isolation valve 138.

Compressor 132 has a compressor outlet 140 connected to a compressor outlet line 142. A pressure gauge 144 and a thermocouple 146 allow monitoring of the discharge pressure and temperature of compressor 132.

A relief valve 148 prevents overpressurization of compressor outlet line 142 and compressor 132. A gas vent valve 150 is installed in parallel with relief valve 148 and may be used to manually vent compressor outlet line 142.

If compressor 132 is of a lubricated type, an oil filter 152 is installed in compressor outlet line 142 to knock out oil which enters the gas stream from compressor 132.

Downstream from oil filter 152, a system outlet line 154 is provided and is adapted for connection to a compressed gas storage vessel 156. Storage vessel 156 is the delivery location of the compressed, vaporized gas from system 10 and does not form a part of the system itself. In other words, system 10 is designed to deliver the cryogenic gas in its gaseous state to storage vessel 156. System outlet line 154 may be opened and closed by a gas valve 158.

In operation, the liquefied cryogenic gas is transferred into delivery vessel 14 through fill and drain connection 38. Because delivery vessel 14 is well insulated by vacuum outer jacket 26, the cryogenic gas therein will remain in its liquid state for a substantial period of time without boiling into a vapor. In other words, the heat transfer rate from ambient air into tank 14 is very, very low.

Mobile chassis 12 is towed to the desired location by vehicle 22. A connection 160 is made with storage vessel 156. Compressor 132 is activated which causes gas to flow through system 10. Liquid will flow from delivery vessel 14 into vaporizer 16 where it is heated to a vapor as previously described. This vapor enters compressor 14, and the compressor transfers the gas into storage vessel 156. Compressor 132 compresses the gas so that the vaporized gas is stored at a relatively high pressure within the storage vessel. Connection 160 is disconnected, and system 10 may then be transported to another location. Gas is consumed from storage vessel 156 in the normal manner.

Figure 3:
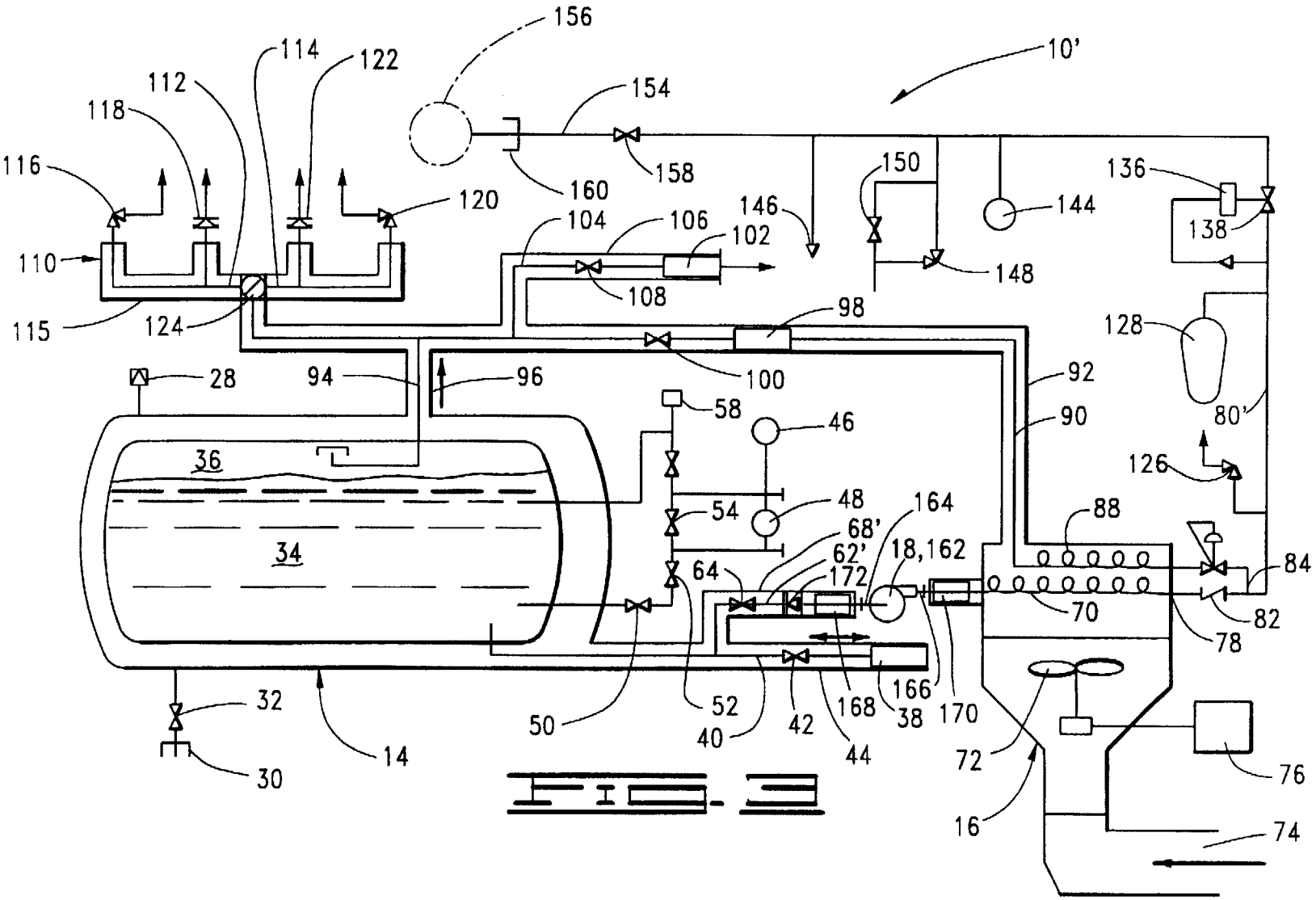
FIG. 3 is a piping schematic of an alternate embodiment of the invention.

Referring again to FIG. 1, a second embodiment of the cryogenic gas transportation and delivery system of the present invention is generally designated by the numeral 10'. FIG. 3 shows second embodiment system 10' illustrated by a piping schematic. Second embodiment system 10 has substantially the same delivery vessel 14 and associated piping, including relief valve manifold 110. All of the instrumentation in system 10' is substantially identical to first embodiment system 10.

In second embodiment system 10', vaporizer 16 is connected to delivery vessel 14 by a vaporizer inlet line 62' which is vacuum insulated such that it has an inlet line jacket 68' therearound. However, unlike first embodiment described. This vapor enters compressor 132, and the means 18 is characterized by a liquid pump 162 which has a pump inlet 164 and a pump outlet 166 connected into vaporizer inlet line 62'. To minimize vibration in vaporizer inlet line 62', vibration eliminators 168 and 170 may be disposed in the vaporizer inlet line on the inlet and outlet sides, respectively, of pump 162. A pump inlet strainer 172 is also disposed in vaporizer inlet line 62' to prevent foreign material from entering pump 162.

In second embodiment system 10', vaporizer outlet 78 is in communication with a vaporizer outlet line 80' which is in communication with system outlet line 154. Essentially, the portion of system 10' downstream from vaporizer 16 is the same as in first embodiment system 10 except that there is no compressor or oil filter.

In operation, second embodiment system 10' is transported to the desired location the same as first embodiment system 10. Connection 160 is made with storage vessel 156. Pump 162 is activated to pump liquid into vaporizer 16 and force the vaporized gas discharged therefrom into storage vessel 156. As with first embodiment system 10', the vaporized gas discharged from second embodiment system 10' is forced into the delivery vessel 156 so that it is stored therein as a compressed gas.

It will seen, therefore, that the cryogenic gas transportation and delivery system of the present invention is well adapted to carry out the ends and advantages mentioned as well as those inherent therein. While presently preferred embodiments of the apparatus have been shown for purposes of this disclosure, numerous changes in the arrangement and construction of the parts and components may be made by those skilled in the art. All such changes are encompassed within the scope and spirit of the appended claims.

What is claimed is:

1. A portable system for delivering a cryogenic gas to a compressed gas storage vessel, said system comprising:

a mobile chassis;

a cryogenic gas delivery vessel disposed on said chassis, said delivery vessel being adapted for storing said gas in a liquefied state;

a vaporizer on said chassis and having a vaporizer inlet in communication with a liquid section of said delivery vessel such that liquefied gas may flow from said delivery vessel to said vaporizer and having a vaporizer outlet, said vaporizer being adapted for heating said liquefied gas received from said delivery vessel such that gas discharged through said vaporizer outlet is in a vaporized state; and a gas compressor having a compressor inlet in communication with said vaporizer outlet and a compressor outlet adapted to be placed in communication with the storage vessel, said compressor being adapted for transferring vaporized gas from said vaporizer to said storage vessel such that liquefied gas will flow from said delivery vessel into said vaporizer.

2. The system of claim 1 wherein said delivery vessel is vacuum jacketed.

3. The system of claim 1 wherein said vaporizer inlet is connected to said delivery vessel with vacuum-jacketed piping.

4. The system of claim 1 further comprising an accumulator in communication with said vaporizer outlet.

5. The system of claim 1 wherein said vaporizer further has a vaporizer bypass in communication with a vapor section of said delivery vessel.

6. The system of claim 5 wherein said vaporizer bypass is connected to said vapor section of said delivery vessel with vacuum-jacketed piping.

7. The system of claim 1 further comprising an oil filter in communication with said compressor outlet.

8. A method of transporting and delivering a cryogenic gas, said method comprising the steps of:

providing a mobile chassis with a delivery vessel thereon, a vaporizer having an inlet in communication with a liquid section of said delivery vessel, and a gas compressor having an inlet in communication with an outlet of said vaporizer;

transferring liquefied cryogenic gas into said delivery vessel;

transporting said chassis with said cryogenic gas in said delivery vessel to a desired location adjacent to a storage vessel; and pumping vaporized gas from said delivery vessel through said gas compressor and discharging said vaporized gas into said storage vessel such that liquefied gas is flowed out of said storage vessel into said vaporizer and vaporized in said vaporizer.

9. The method of claim 8 further comprising the step of bypassing excess vaporized gas to a vapor section of said delivery vessel.

* * * * *